US011524190B1

(12) United States Patent
Rokvic

(10) Patent No.: US 11,524,190 B1
(45) Date of Patent: Dec. 13, 2022

(54) SMOKE BAFFLE ASSEMBLY AND METHOD OF INSTALLATION

(71) Applicant: Ilija Rokvic, Independence, KY (US)

(72) Inventor: Ilija Rokvic, Independence, KY (US)

( * ) Notice: Subject to any disclaimer, the term of this patent is extended or adjusted under 35 U.S.C. 154(b) by 0 days.

(21) Appl. No.: 17/744,621

(22) Filed: May 13, 2022

(51) Int. Cl.
*A62C 2/10* (2006.01)
*E04B 1/94* (2006.01)

(52) U.S. Cl.
CPC ..... *A62C 2/10* (2013.01); *E04B 1/941* (2013.01)

(58) Field of Classification Search
CPC ..... A62C 2/10; E04B 1/941
See application file for complete search history.

(56) References Cited

U.S. PATENT DOCUMENTS 3,696,571 A * 10/1972 Schluter ..... E04B 9/34 52/506.06
4,124,021 A * 11/1978 Molitor ..... B23P 15/26 55/DIG. 36
4,725,324 A * 2/1988 Schmidt ..... E04B 1/941 156/304.3
4,733,514 A * 3/1988 Kelly ..... E04B 1/941 52/317
5,546,711 A * 8/1996 Heller ..... E04B 1/941 248/638
5,809,699 A * 9/1998 Joly ..... A62C 2/10 160/1
6,918,447 B2 * 7/2005 Robinson, Jr. ..... E06B 9/0692 169/48
9,052,117 B2 * 6/2015 Ajmera ..... A21B 3/00
10,745,917 B2 * 8/2020 Ndobo-Epoy ..... E04D 13/1637
11,274,442 B2 * 3/2022 Nilsson ..... E04B 9/363
11,365,541 B2 * 6/2022 Rivas ..... E04B 9/241
2004/0159448 A1 * 8/2004 Robinson, Jr. ..... A62C 2/10 169/48
2012/0270171 A1 * 10/2012 Ajmera ..... A21B 3/00 432/249
2016/0178146 A1 * 6/2016 Oleske ..... E04B 9/006 52/28
2017/0183875 A1 * 6/2017 Ndobo-Epoy ..... E04D 13/1637
2019/0336801 A1 * 11/2019 Edwards ..... E06B 9/17007
2021/0164225 A1 * 6/2021 Nilsson ..... E04B 9/363
2021/0214940 A1 * 7/2021 Rivas ..... E04B 9/003
2022/0112714 A1 * 4/2022 Rivas ..... E04B 9/001

* cited by examiner

*Primary Examiner* — Rodney Mintz
(74) *Attorney, Agent, or Firm* — Witters & Associates; Steve Witters

(57) ABSTRACT

Technologies are described for a smoke baffle assembly and method of installation. The smoke baffle has a longitudinally extending base with an upper leg, a first leg, and a second leg. A first flange extends inward form the first leg and a second flange extends inward from the second leg. A smoke baffle holder holds an upper portion of a smoke baffle and has a first and second outward extending flange. Each of the outward extending flanges and inward extending flanges is configured and disposed for moving the outward extending flanges into the base and above the inward extending flanges and holding the smoke baffle in the base.

14 Claims, 7 Drawing Sheets

SMOKE BAFFLE ASSEMBLY AND METHOD OF INSTALLATION

FIELD OF THE DISCLOSURE

This invention generally relates to smoke baffles and the installation of smoke baffles.

BACKGROUND

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

A smoke baffle or draft curtain is a substantially noncombustible curtain that is hung tightly against a ceiling to cordon off sections for fire prevention purposes. A smoke baffle acts as a partition and corrals heat and smoke in the event of a fire. The depth of the heat and smoke contained within the curtained area may affect how quickly sprinklers are activated. Installation requirements and specifications of smoke baffles are regulated or defined by regulations or guidance. For example, the National Fire Protection Association, NFPA, provides that a smoke baffle is to drop a minimum of 18 inches from the ceiling.

Present smoke baffles may be laborious or costly to install. It may be desired to install a smoke baffle that provides for reduced installation labor and associated costs.

SUMMARY

In at least one embodiment of the present disclosure, a smoke baffle assembly is disclosed. The smoke baffle assembly has a longitudinally extending base with an upper leg configured and disposed to be mounted to an upper surface of a structure. A first leg and a second leg depend downward from parallel edges of the upper leg. A first flange extends inward form the first leg and a second flange extends inward from the second leg. A smoke baffle holder holds an upper portion of a smoke baffle and has a first outward extending flange and a second outward extending flange. Each of the inward extending flanges of the base and each of the outward extending flanges of the smoke baffle holder are configured and disposed for the moving of the first outward extending flange of the smoke baffle holder into the base and above the first outward extending flange of the base and to move the second outward extending flange of the smoke baffle holder into the base and above the second outward extending flange of the base.

In at least one other embodiment of the present disclosure, a method of installing a smoke baffle to a structure is disclosed. The method comprises mounting an upper leg of a longitudinally extending base to an upper surface of the structure; extending legs downward from parallel edges of the upper leg and extending flanges inward from each of the downward extending legs; fastening a smoke baffle holder to an upper portion of a smoke baffle and outward extending flanges from the smoke baffle; orienting the smoke baffle at an angle $\alpha$, with respect to the upper leg of the base, and moving the outward extending flanges of the smoke baffle holder between and above each of the inward extending flanges of the base; orienting the smoke baffle to approximately perpendicular to the upper leg of the base or the upper surface of the structure; and lowering the smoke baffle and resting the outward extending holder flanges on the inward extending flanges of the base and holding the smoke baffle with the base.

BRIEF DESCRIPTIONS OF THE DRAWINGS

The foregoing and other features of this disclosure will become more fully apparent from the following description and appended claims, taken in conjunction with the accompanying drawings and examples. Understanding that these drawings depict only several embodiments in accordance with the disclosure and are, therefore, not to be considered limiting of its scope, the disclosure will be described with additional specificity and detail through use of the following figures, which are idealized, are not to scale and are intended to be merely illustrative of aspects of the present disclosure and non-limiting. In the drawings, like elements are depicted by like reference numerals. The drawings are briefly described as follows:

DETAILED DESCRIPTION

Figure 1:
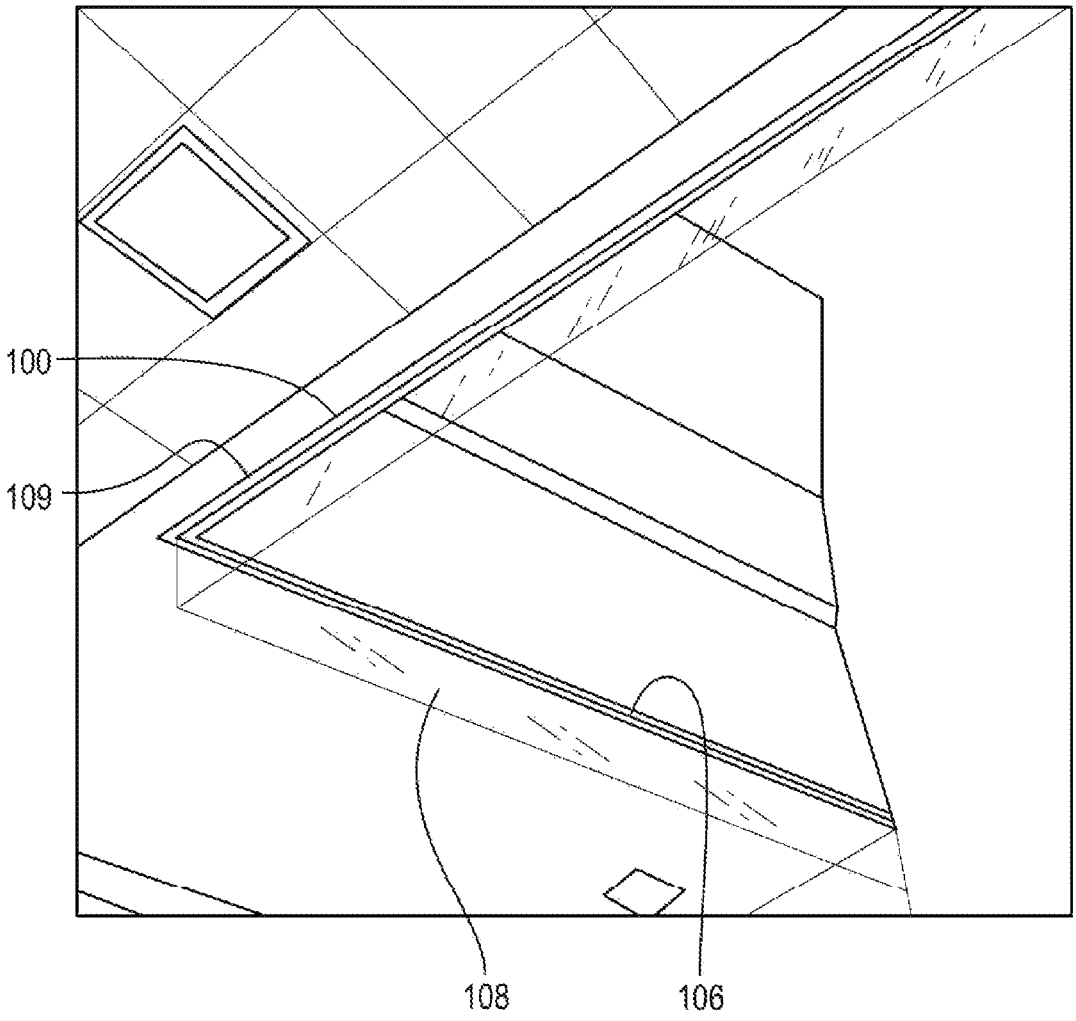
FIG. 1 shows an illustrative perspective view of the presently disclosed smoke baffle assembly installed to an upper portion of a structure.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Presently disclosed is a smoke baffle assembly and a method of installing a smoke baffle. In at least one embodiment, the presently disclosed smoke baffle assembly provides for a less laborious or costly installation. The smoke baffle assembly has lengths of a base, a smoke baffle holder, and a smoke baffle extending from the smoke baffle holder. The longitudinally extending components may be provided in lengths of several feet or inches. For example, the base and the smoke baffle holder may be extruded to lengths of between about 2 to 20 feet, or longer or shorter, in increments of a fraction of an inch. In at least one embodiment, the base, cover, smoke baffle holder comprise extruded aluminum.

The base is configured to be mounted to an upper surface of a structure. For example, the base may be installed to the structure wherein a bottom slot is disposed proximate a ceiling. In at least one embodiment, the longitudinally extending base has a slot opening substantially within a plane of the ceiling. The slot opening in the base has an inward extending flange, extending inward from each longitudinal side of the base.

A smoke baffle holder is secured or attached to an upper portion of a longitudinally extending smoke baffle. The baffle holder provides outward extending flanges, a flange extending outward from each side of the smoke baffle.

The base and the smoke baffle holder are configured and disposed to provide for an angular insertion of the smoke baffle holder into the base. Upon the outward extending flanges of the smoke baffle holder being positioned above the inward extending flanges of the base, the smoke baffle may be rotated from the angular orientation to a vertical orientation. The vertical orientation and lowering of the smoke baffle provides for the outward extending flanges to rest on the inward extending flanges and hold the smoke baffle with the base.

FIG. 1 shows an illustrative perspective view of smoke baffle assembly 100 installed to an upper portion of a structure. Smoke baffle assembly 100 has a longitudinally extending base mounted to an upper surface of the structure. A first leg and a second leg extend down to a plane of ceiling 101. Upon installation, first flange 109 extends inward form the first leg substantially in the plane of ceiling 101. A smoke baffle holder is positioned in the base holds an upper portion of a smoke baffle 108. Smoke baffle 108 vertically extends from ceiling 101. For example, a bottom surface of first inward extending flange 109 may be planar and the smoke baffle assembly may have a cover 106 held with the base and the smoke baffle holder. As illustrated in FIG. 1, the base may be installed to an upper surface of the structure wherein the base is positioned substantially above ceiling 101. Having the smoke baffle holder positioned in the base, first planar flange 109, smoke baffle 108, and cover 106 are visible.

In at least one embodiment, the assembly of the present disclosure may be installed wherein only the smoke baffle and a strip of material down each of side of the smoke baffle are visible from below the ceiling. For example, only inward extending flange(s) or cover(s), which may be metallic, and the smoke baffle may be visible, as shown in FIG. 1. The strips of material extending the length of the smoke baffle may be disposed substantially in the plane of the ceiling. It is to be understood that smoke baffle assembly 100 may be installed with an upper portion of a structure or to a ceiling, wherein side portions of the base may be visible from below.

Figure 2:
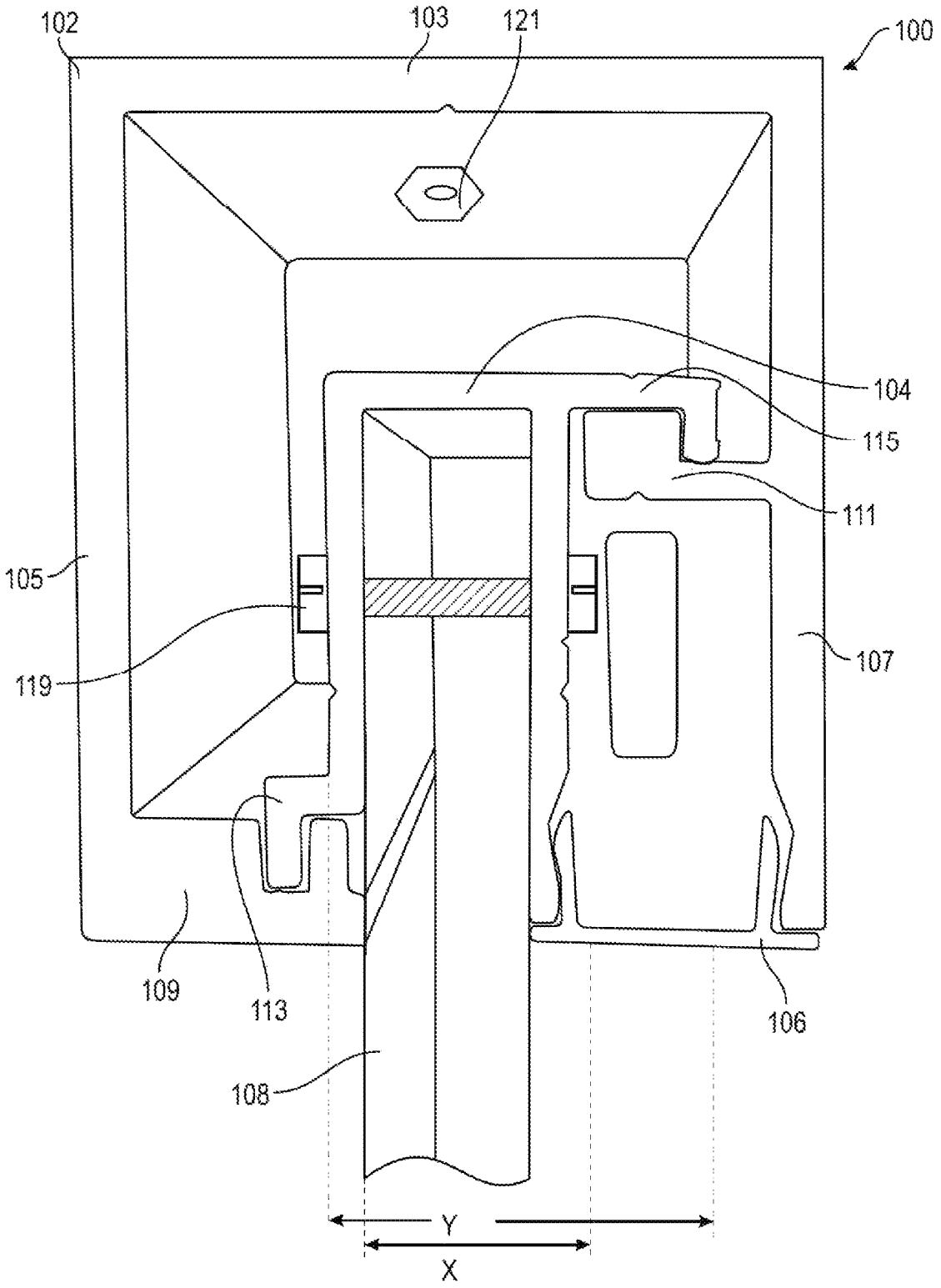
FIG. 2 shows an illustrative end view of a section of the smoke baffle assembly shown in FIG. 1.

FIG. 2 shows an illustrative end view of a section of smoke baffle assembly 100. Smoke baffle assembly 100 may have a longitudinally extending base 102 with an upper leg 103 configured and disposed to be mounted to an upper surface of a structure. A first leg 105 and a second leg 107 may each depend downward from parallel edges of upper leg 103. A first flange, 109 may extend inward form first leg 105 and a second flange 111 may extend inward from second leg 107. First flange 105 and second flange 107 have a horizontal distance x therebetween.

Smoke baffle holder 104 holds an upper portion of a smoke baffle 108. Smoke baffle holder 108 has a first outward extending flange 113 and a second outward extending flange 115. The outward extending flanges extend outwardly from the smoke baffle 108 a horizontal distance y. With baffle 108 in a vertical orientation, horizontal distance y is greater than the horizontal distance x. Such a configuration provides for first outward extending flange 113 to rest on inward extending flange 109 and second outward extending flange 115 to rest on second inward extending flange 111, upon smoke baffle 108 being oriented in a vertical position as shown in FIG. 2.

The first inward extending flange 109 may extend inward from the first leg 105 a first distance from the upper leg 103 and the second inward extending flange 111 may extend inward from the second leg a second distance from upper leg 103. The first and the second distances may be different. For example, the first distance may be greater than the second distance and first outward extending flange 113 may be configured and disposed rest on the first inward extending flange 109 and the second outward extending flange 115 may be configured and disposed rest on the second inward extending flange 111, upon the smoke baffle being vertically oriented with respect to upper leg 103 of base 102. For example, one of the inward extending legs may be configured and disposed to be visible upon installation as shown in FIG. 1.

In at least one embodiment, smoke baffle assembly 100 may have at least one fastener, 119 and/or 121. For example, smoke baffle 100 may have fasteners 121 disposed along its length. Fasteners 121 are configured and disposed to mount upper leg 103 to the upper surface of a structure. In at least one embodiment, smoke baffle assembly has a plurality of longitudinally spaced fasteners 119 configured and disposed to hold smoke baffle 108 with the smoke baffle holder 104. Smoke baffle assembly 100 may have a bottom planar surface. For example, at least one of the inward extending flanges, 109 and 111, may be planar. For example, first inward extending flange 109 may extend inward from a lower edge of first leg 105 and may have a planar bottom surface as shown in FIGS. 1 and 2.

In at least one embodiment, smoke baffle assembly 100 may have a bottom surface of first inward extending flange 109 and smoke baffle assembly 100 may have a cover 106 configured and disposed to be held between second leg 107 and the smoke baffle holder 104, covering an opening between base 102 and smoke baffle holder 104. One or both of cover 106 and first inward extending leg 109 may have a planar bottom surface, or other desired configuration for ornamentation. In at least one embodiment, smoke baffle assembly has a planar upper leg 103, first leg 105, and second leg 107.

Figure 3:
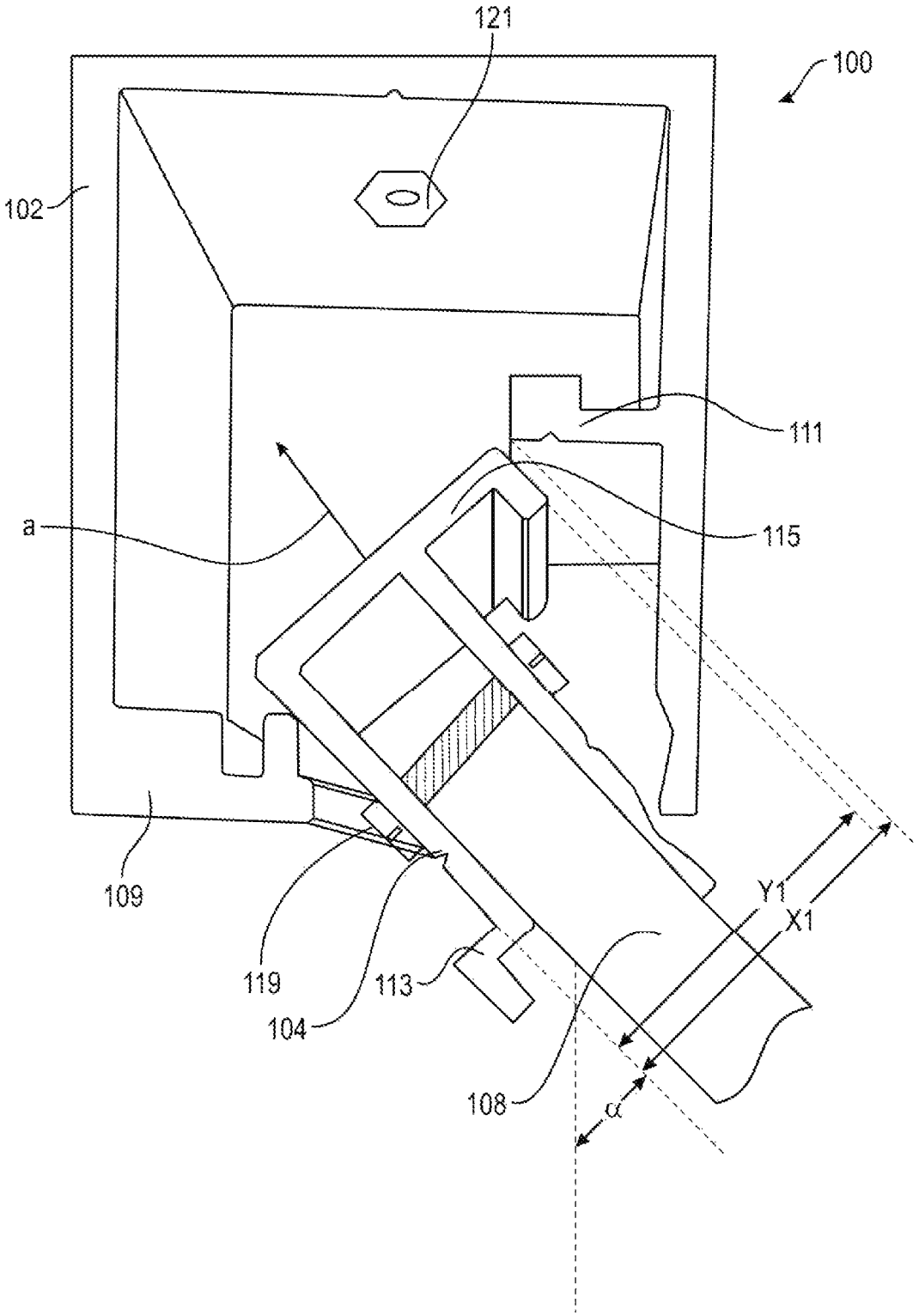
FIG. 3 shows the illustrative end view of portions of the smoke baffle assembly shown in FIG. 2 having an angled orientation a of the smoke baffle for installation.

FIG. 3 shows an illustrative end view of portions of smoke baffle assembly 100 having an angled orientation a of smoke baffle 108 for installation. For example, an angled orientation a of smoke baffle 108, with respect to base 102 or upper leg 103, provides for an angular distance x1 between each of the inward extending flanges, 109 and 111, and an angular distance y1 between the outward extending flanges, 113 and 115. Angular distance y1 is less than the angular distance x1, thus enabling smoke baffle holder 104 to be inserted into base 102 as shown with arrow a. Angle $\alpha$ may be any angle between about 10 and 80 degrees. For example, a may be between about 30 and 60 degrees or about 40 degrees.

It is to be understood that that the angular distance x1 between each of the inward extending flanges, 109 and 111, may need not be greater than the angular distance y1 between the outward extending flanges, 113 and 115, for baffle holder 104 to be mounted with base 102. For example, each of the inward extending flanges, 109 and 111, and each of the outward extending flanges, 113 and 115, may be configured and disposed to move one of the outward extending flanges above an inward extend flange and then move the smoke baffle, angularly, laterally, and/or horizontally, to move the other outward extending flange above the other inward extend flange, essentially walking the smoke baffle into a position to be held with base 102.

Figure 4:
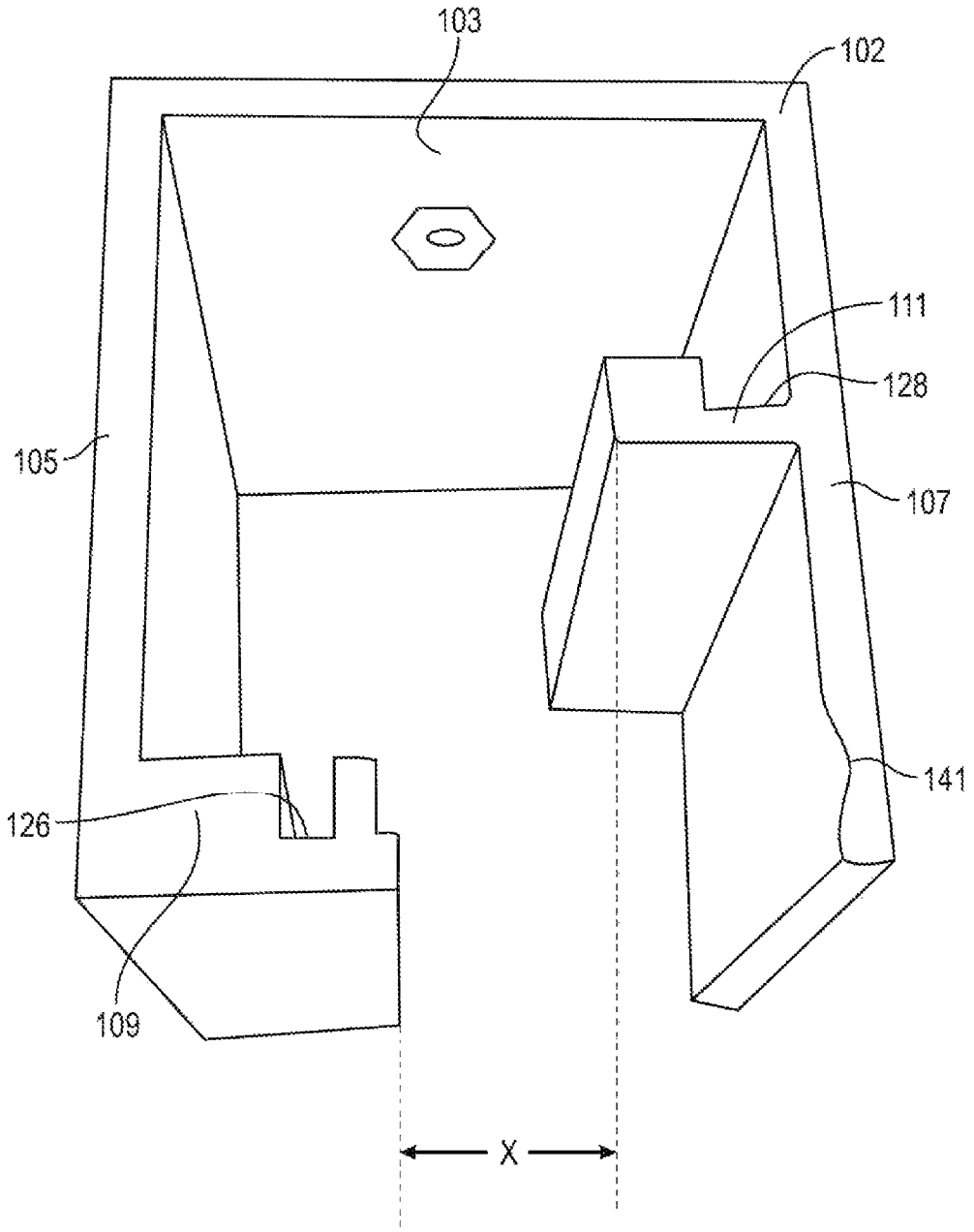
FIG. 4 shows an illustrative end view of a portion of the longitudinally extending base shown in FIG. 2.
Figure 5:
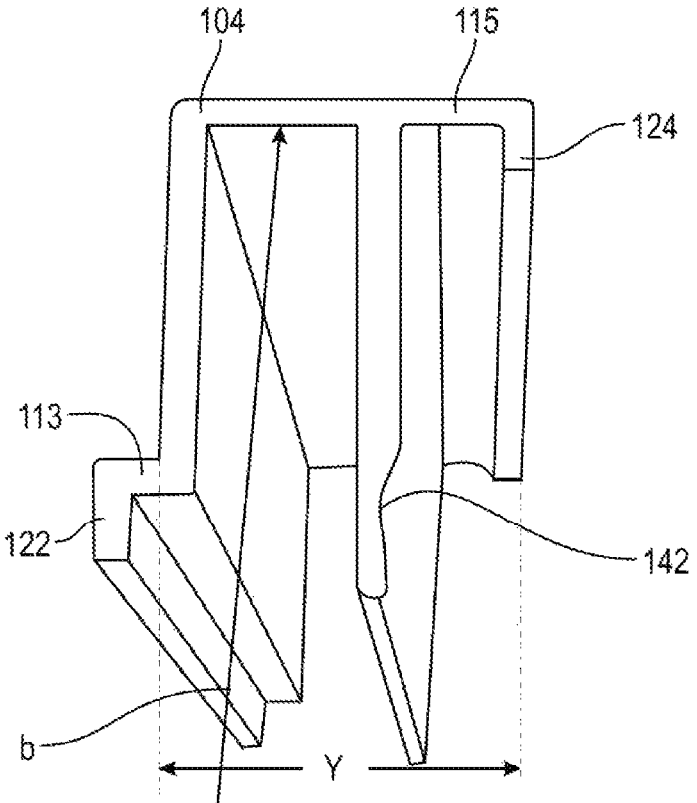
FIG. 5 shows an illustrative end view of a portion of the longitudinally extending smoke baffle holder shown in FIG. 2.

FIG. 4 shows an illustrative end view of a portion of longitudinally extending base 102. Base 102 may have first inward extending flange 109 extending inward from first leg 105 a first distance from the upper leg 103 and second inward extending flange 111 may extend inward from second leg 107 a second distance from upper leg 103, the first distance may be greater than the second distance. For example, first inward extending flange 109 may extend inward from a lower edge of first leg 105. First outward extending flange 113 of smoke baffle holder 104 is configured and disposed rest on first inward extending flange 109 and second outward extending flange 115 is configured and disposed rest on second inward extending flange 111, upon smoke baffle 108 being vertically oriented with respect to upper leg 103 of base 102. FIG. 5 shows an illustrative end view of a portion of longitudinally extending smoke baffle holder 104. Smoke baffle holder 104 is configured and disposed to be angularly inserted into base 102 and to hold smoke baffle 108 to an upper surface of a structure, upon smoke baffle 108 being placed in a vertical orientation with respect to upper leg 103.

In at least one embodiment, at least one of the first and the second outward extending flanges, 113 and 115, has a rib, 122 or 124, and at least one of the first and the second inward extending flanges, 109 and 111, has a trough, 126 or 128. The trough is configured and disposed to receive the rib, upon smoke baffle 108 being vertically oriented with respect to the upper leg 103 of base 102. A ridge and trough combination may provide lateral stability or support of the smoke baffle upon being mounted with the base.

In at least one embodiment, baffle assembly 100 has first outward extending flange 113 disposing a first rib 122 and second outward extending flange 115 disposing a second rib 124. First inward extending flange 109 has a first trough 126 and second inward extending flange 111 has a second trough 128. First trough 126 is configured and disposed to receive the first rib 122 and second trough 128 is configured and disposed to receive second rib 124, upon smoke baffle 108 being vertically oriented with respect to upper leg 103 of base 102.

Figure 6:
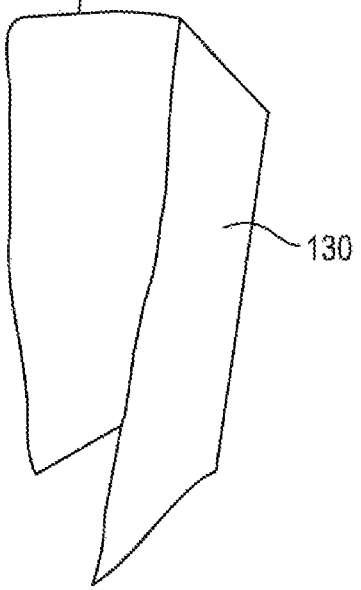
FIG. 6 shows an illustrative perspective view of a gasket that may be a component part of the smoke baffle assembly shown in FIG. 2.
Figure 7:
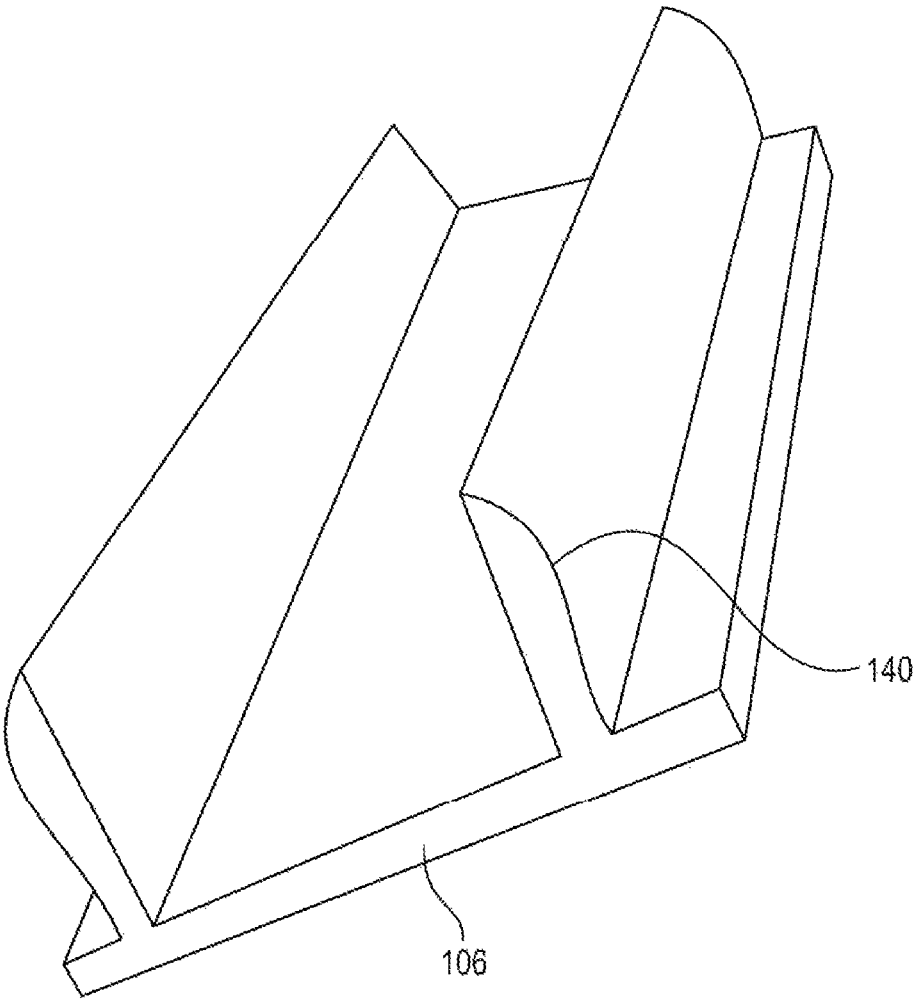
FIG. 7 shows an illustrative end view of a portion of the longitudinally extending cover shown in FIG. 1.

FIG. 6 shows an illustrative perspective view of gasket 130 that may be a component part of the smoke baffle assembly 100. In at least one embodiment, smoke baffle assembly 100 has a gasket 130 configured and disposed to be inserted, as shown with arrow b, and held in smoke baffle holder 104 and about the upper portion of smoke baffle 108. FIG. 7 shows an illustrative end view of a portion of a longitudinally extending cover 106. In at least one embodiment, smoke baffle assembly 100 has first inward extending flange 109 with a bottom surface configured and disposed to be visible upon installation. The bottom surface of first inward extending flange 109 may be planar or have other desired design or configuration. A cover 106 may be provided with smoke baffle 100. Cover 106 is configured and disposed to be held between the second leg 107 and the smoke baffle holder 104. A bottom surface of cover 106 may be planar or have other desired design or configuration.

In at least one embodiment, cover 106 has legs with a bump out 140 configured to fit in recesses 141 in second leg 107 and 142 in smoke baffle holder 104. For example, upon installation of smoke baffle 108 in base 102, cover 106 may be snapped or longitudinally slid between base 102 and smoke baffle holder 104 and be held therewith.

Figure 8:
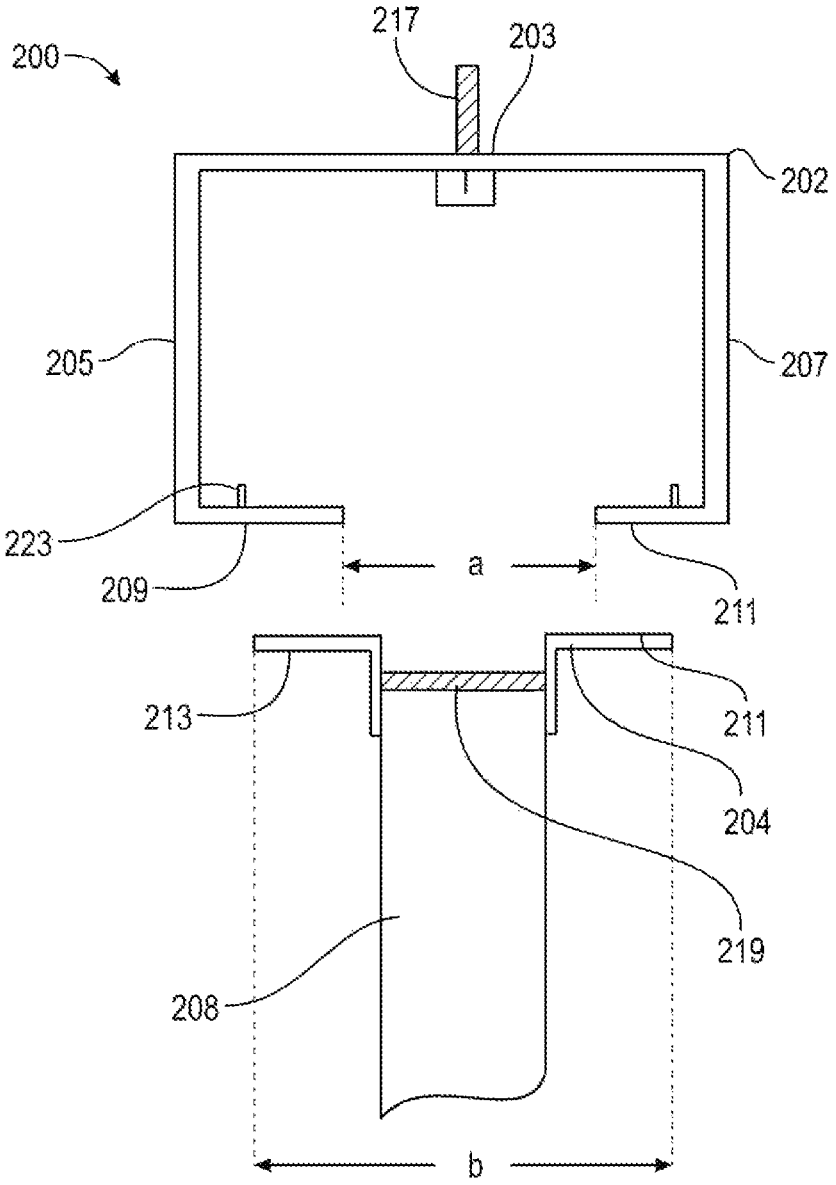
FIG. 8 shows an alternative embodiment of the presently disclosed smoke baffle assembly.

FIG. 8 shows smoke baffle assembly 200. Smoke baffle assembly 200 has a longitudinally extending base 202. Base 202 has an upper leg 203 configured and disposed to be mounted to an upper surface of a structure. For example, upper leg 203 may be mounted with fastener 217. Base 202 has a first leg 205 and a second leg 207, each of the legs depend downward from parallel edges of upper leg 203. A first flange 209 extends inward form first leg 205 and a second flange 211 extends inward from second leg 207. First flange 205 and second flange 207 have a horizontal distance a therebetween;

A smoke baffle holder 204 holds an upper portion of a smoke baffle 208. Smoke baffle holder 204 has a first outward extending flange 213 and a second outward extending flange, 215. The outward extending flanges may be held to smoke baffle 208 with fastener 219 and may extend outwardly from the smoke baffle 208 a horizontal distance b. The horizontal distance b is greater than the horizontal distance a, enabling first outward extending flange 213 to rest on first inward extending flange 209 and second outward extending flange 215 to rest on second inward extending flange 211, upon smoke baffle holder 204 being placed in base 202 and orienting smoke baffle 208 vertically with respect to top leg 203. Bumps or extensions 223 may be on an upper surface of the inward extending legs to provide for lateral stability of smoke baffle 208 upon installation with base 202.

First and second outward extending flanges 213 and 215 and first and second inward extending flanges 209 and 211 are configured and disposed to provide for the movement of smoke baffle holder 204 through separation a between the inward extending legs, upon smoke baffle 208 being angled from the vertical orientation with respect to upper le 203.

A method of installing a smoke baffle to a structure is presently disclosed. The smoke baffle of the present disclosure may be installed by mounting an upper leg of a longitudinally extending base to an upper surface of the structure; extending legs downward from parallel edges of the upper leg and extending flanges inward from each of the downward extending legs; fastening a smoke baffle holder to an upper portion of a smoke baffle and outward extending flanges from the smoke baffle; orienting the smoke baffle at an angle $\alpha$, with respect to the upper leg of the base, and moving the outward extending flanges of the smoke baffle holder between and above each of the inward extending flanges of the base; orienting the smoke baffle to approximately perpendicular to the upper leg of the base or the upper surface of the structure; and lowering the smoke baffle and resting the outward extending holder flanges on the inward extending flanges of the base and holding the smoke baffle with the base.

The method installing the smoke baffle may also comprise inserting a cover between one of the downward extending legs and the smoke baffle holder and holding the cover therebetween. A gasket may be placed about the upper portion of the smoke baffle.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

The present disclosure is to be limited only by the terms of the appended claims, along with the full scope of equivalents to which such claims are entitled. It is to be understood that this disclosure is not limited to particular structures, configurations, methods, or systems, which can, of course, vary. It is also to be understood that the terminology used herein is for the purpose of describing particular embodiments only, and is not intended to be limiting.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

The invention claimed is:

1. A smoke baffle assembly comprising:

a longitudinally extending base comprising:

an upper leg configured to be mounted to an upper surface of a structure;

a first leg and a second leg, each of the legs depending downward from parallel edges of the upper leg; and a first flange extending inward from the first leg and a second flange extending inward from the second leg, wherein the first inward extending flange and the second inward extending flange have a horizontal distance (x) therebetween;

a smoke baffle holder holding an upper portion of a smoke baffle therein;

the smoke baffle holder having a first outward extending flange and a second outward extending flange; and wherein the base is configured to be disposed to or attached to a ceiling;

wherein the smoke baffle holder is removably received in the base such that each of the inward extending flanges of the base and each of the outward extending flanges of the smoke baffle holder are configured to move the first outward extending flange of the smoke baffle holder into the base and above the first inward extending flange of the base and to move the second outward extending flange of the smoke baffle holder into the base and above the second inward extending flange of the base.

2. The smoke baffle assembly of claim 1, wherein the outward extending flanges extend outward from the smoke baffle holder a horizontal distance (y);

wherein the horizontal distance (y) is greater than the horizontal distance (x);

wherein an angled orientation ($\alpha$) of the smoke baffle, with respect to the upper leg of the base, provides for an angular distance (x1) between each of the inward extending flanges and an angular distance (y1) between the outward extending flanges; and wherein the angular distance (y1) is less than the angular distance (x1).

3. The smoke baffle assembly of claim 1 being configured and disposed for installing the base substantially above the ceiling and providing visibility solely of the smoke baffle and a strip of material along each side of the smoke baffle.

4. The smoke baffle assembly of claim 1, wherein at least one of the first and the second outward extending flanges has a rib and at least one of the first and the second inward extending flanges has a trough configured and disposed to receive the rib, upon the smoke baffle being vertically oriented with respect to the upper leg of the base.

5. The smoke baffle assembly of claim 1, wherein the first outward extending flange has a first rib and the second outward extending flange has a second rib, the first inward extending flange has a first trough and the second inward extending flange has a second trough, the first trough is configured and disposed to receive the first rib and the second trough is configured and disposed to receive the second rib, upon the smoke baffle being vertically oriented with respect to the upper leg of the base.

6. The smoke baffle assembly of claim 1 further comprising at least one fastener, wherein the at least one fastener is configured and disposed to the mount upper leg to the upper surface of the structure or to hold the smoke baffle with the smoke baffle holder.

7. The smoke baffle assembly of claim 1, wherein a bottom surface of at least one of the inward extending flanges is planar.

8. The smoke baffle assembly of claim 1 further comprising a gasket configured and disposed to be held in the smoke baffle holder and about the upper portion of the smoke baffle.

9. The smoke baffle assembly of claim 1, wherein the upper leg, the first leg, and the second leg are each planar.

10. The smoke baffle assembly of claim 1, wherein the first inward extending flange extends inward from the first leg a first distance from the upper leg and the second inward extending flange extends inward from the second leg a second distance from the upper leg, the first distance being greater than the second distance, the first outward extending flange is configured and disposed rest on the first inward extending flange and the second outward extending flange is configured and disposed rest on the second inward extending flange, upon the smoke baffle being vertically oriented with respect to the upper leg of the base.

11. The smoke baffle assembly of claim 10, wherein a bottom surface of the first inward extending flange is planar and the smoke baffle assembly has a cover configured and disposed to be held between the second leg and the smoke baffle holder, the cover has a planar bottom surface.

12. A method of installing a smoke baffle to a structure comprising the steps of:

mounting an upper leg of a longitudinally extending base to an upper surface of the structure;

extending legs downward from parallel edges of the upper leg and extending flanges inward from each of the downward extending legs;

fastening a smoke baffle holder to an upper portion of a smoke baffle and outward extending flanges from the smoke baffle holder;

orienting the smoke baffle at an angle, with respect to the upper leg of the base, and moving the outward extending flanges of the smoke baffle holder between and above each of the inward extending flanges of the base;

orienting the smoke baffle to approximately perpendicular to the upper leg of the base or the upper surface of the structure; and lowering the smoke baffle and resting the outward extending holder flanges on the inward extending flanges of the base and holding the smoke baffle with the base.

13. The method of claim 12 further comprising inserting a cover between one of the downward extending legs and the smoke baffle holder and holding the cover therebetween.

14. The method of claim 12 further comprising placing a gasket about the upper portion of the smoke baffle.

* * * * *